US007814586B1

(12) United States Patent
Samuels

(10) Patent No.: US 7,814,586 B1
(45) Date of Patent: Oct. 19, 2010

(54) PORTABLE SHOWER SYSTEM

(76) Inventor: Lila A. Samuels, 1813 Sherwood Cir., Clearwater, FL (US) 33764

( * ) Notice: Subject to any disclaimer, the term of this patent is extended or adjusted under 35 U.S.C. 154(b) by 0 days.

(21) Appl. No.: 12/456,649

(22) Filed: Jun. 19, 2009

Related U.S. Application Data

(60) Provisional application No. 61/134,030, filed on Jul. 3, 2008.

(51) Int. Cl.
*A47K 3/22* (2006.01)
*A47K 3/34* (2006.01)
*A47K 3/36* (2006.01)

(52) U.S. Cl. ..... 4/615; 4/612

(58) Field of Classification Search ..... 4/570, 4/599, 602, 603, 612, 615–617, 622
See application file for complete search history.

(56) References Cited

U.S. PATENT DOCUMENTS 3,925,830 A * 12/1975 Delaney ..... 4/615
3,939,503 A * 2/1976 Nazworth ..... 4/616

* cited by examiner

*Primary Examiner*—Tuan N Nguyen

(57) ABSTRACT

A base assembly has a major section with an open top, a minor section with a top panel and a cover plate with a down-turned flange. The cover plate is positioned over the major section. Springs between the cover plate and the major section hold the cover plate in an inoperative orientation above the major section and an operative orientation in contact with the major section. A J-shaped tube has a lower end operatively coupled with the minor section and extending upwardly from the top panel. The J-shaped tube has an upper end with a primary sprinkler head positioned over the major section. A water path includes an input coupling on the major section for receiving water from a hose. The water path includes an output coupling on the top panel for removably receiving the lower end of the J-shaped tube.

5 Claims, 3 Drawing Sheets

FIG 1
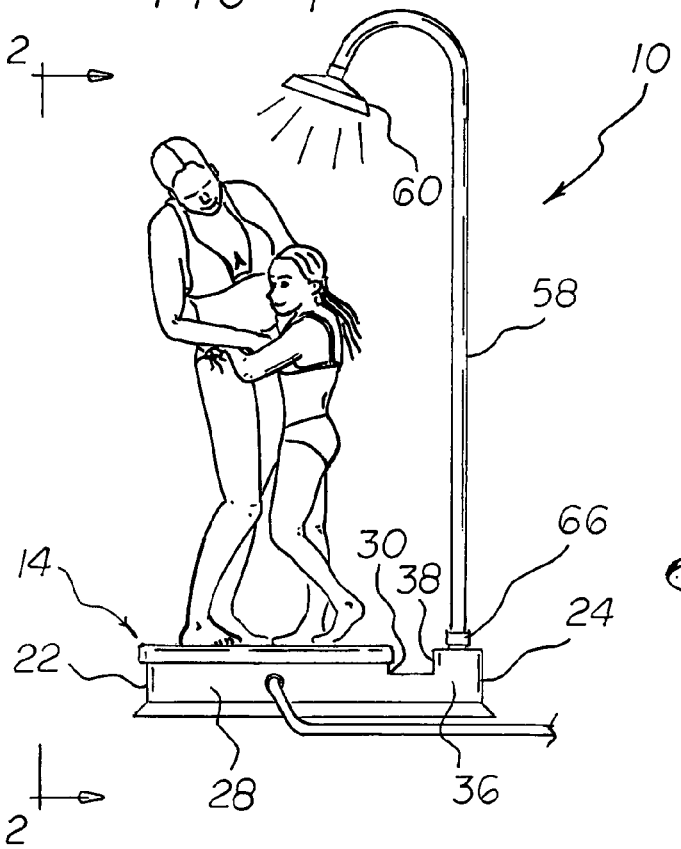
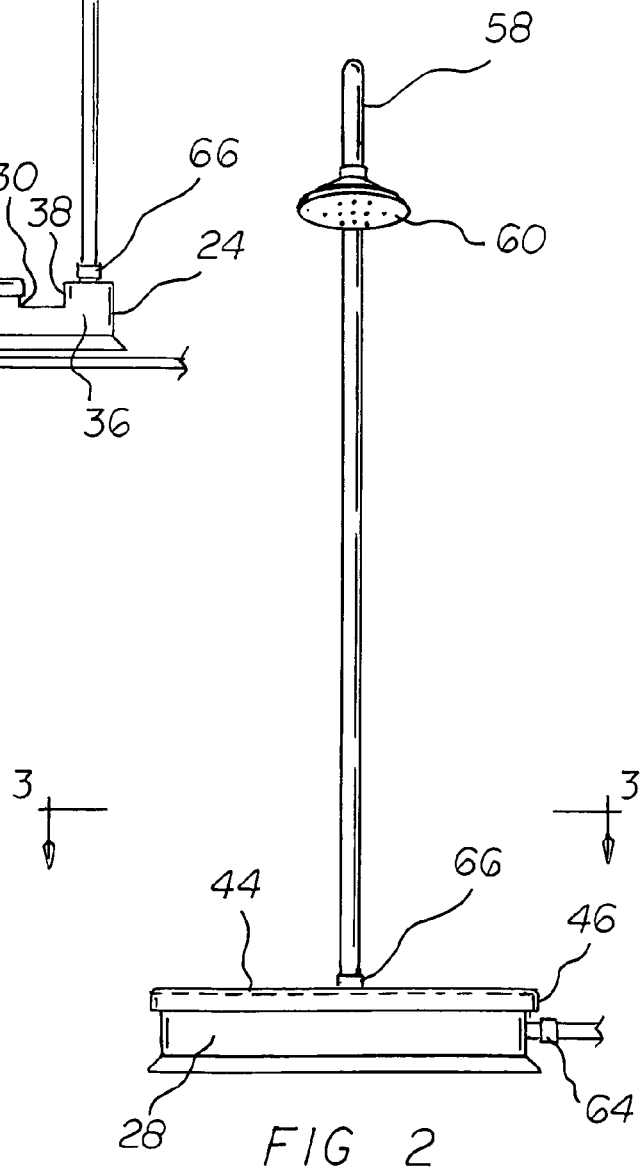
FIG 2

FIG 3
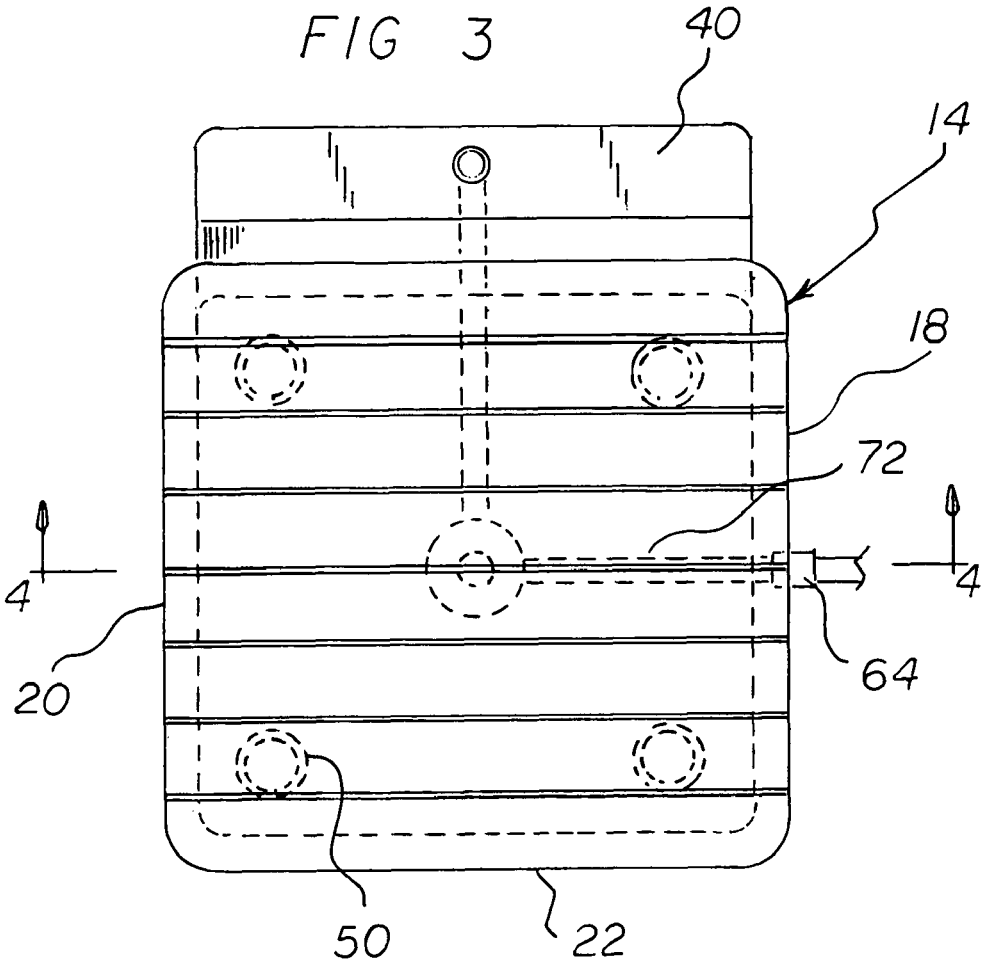
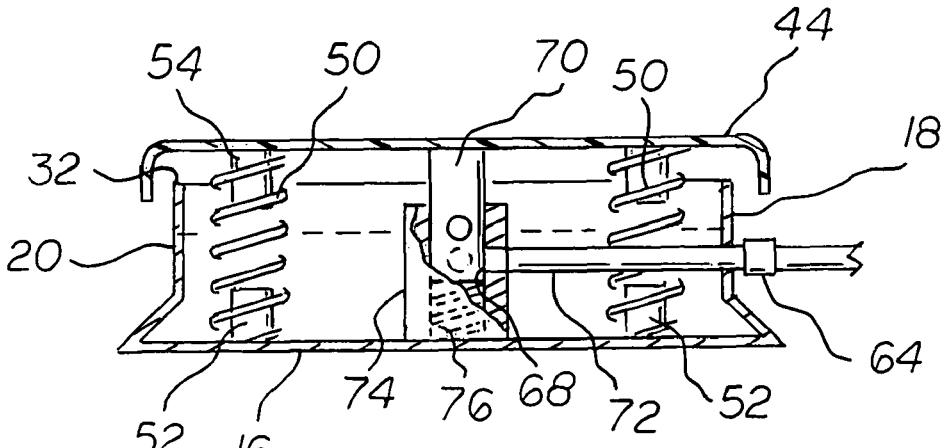
FIG 4

PORTABLE SHOWER SYSTEM

RELATED APPLICATION

The present non-provisional patent application is based upon pending Provisional Application Ser. No. 61/134,030 filed Jul. 3, 2008, the subject matter of which is incorporated herein by reference.

BACKGROUND OF THE INVENTION

1. Field of the Invention

The present invention relates to a portable shower system and more particularly pertains to initiating and terminating the flow of shower water in response to the presence and absence of at least one person positioned in a path of flow of the shower water, the initiating and terminating being in a safe, convenient and economical manner.

2. Summary of the Invention

In view of the disadvantages inherent in the known types of shower systems of known designs and configurations now present in the prior art, the present invention provides an improved portable shower system. As such, the general purpose of the present invention, which will be described subsequently in greater detail, is to provide a new and improved portable shower system and method which has all the advantages of the prior art and none of the disadvantages.

To attain this, the present invention essentially comprises a portable shower system. First provided is a base assembly. The base assembly is in a generally rectilinear configuration. The base assembly has a floor. The floor is positionable upon a recipient surface. The base assembly has a front wall. The base assembly has a rear wall. The base assembly has a first side wall. The base assembly also has a second side wall. The front and rear walls are parallel. The front and rear walls have a common length. The first and second side walls are parallel. The first and second side walls have a common length. The length of the first and second side walls is less than the length of the front and rear walls. The front and rear walls are perpendicular to the first and second side walls.

The base assembly has a square major section. The major section is formed of the first side wall and major portions of the front and rear walls. The major section has a major intermediate wall. The major intermediate wall is provided between the front and rear walls. The major intermediate wall is parallel with the first side wall. The major section has an open top. The open top is in a square configuration.

The base assembly has a minor section. The minor section is formed of the second side wall and minor portions of the front and rear walls. The minor section has a minor intermediate wall. The minor intermediate wall is provided between the front and rear walls. The minor intermediate wall is parallel with the second side wall. The minor section has a top panel. The top panel is in a rectangular configuration. The top panel is laterally offset from the major section.

A cover plate is provided. The cover plate is in a square configuration. The cover plate is positioned over the open top of the major section. The cover plate has a down-turned flange. The down-turned flange encompasses an upper extent of the first side wall and major portions of the front and rear walls and the major intermediate wall. The cover plate and housing are fabricated of a rigid, water resistant material. The rigid, water resistant material is selected from the class of rigid materials. The class of rigid materials includes plastic and metal. The cover plate has water directing grooves.

Four vertically positioned coil springs are provided next. The coil springs have upper ends and lower ends. One of the coil springs is located adjacent to each corner of the square major section. Four lower stubs are provided. The lower stubs extend upwardly from the floor. Each lower stub receives the lower end of one of the coil springs. Four upper stubs are provided. The upper stubs extend downwardly from the cover plate. Each upper stub receives the upper end of one of the coil springs. The coil springs are of a length to hold the cover plate in a horizontal inoperative orientation. In the horizontal inoperative orientation the cover plate is above the major section when no person is standing on the cover plate. The coil springs are of a length to hold the cover plate in a horizontal operative orientation. In the horizontal operative orientation the cover plate is in contact with the major section when at least one person is standing on the cover plate.

Provided next is a generally J-shaped primary tube. The primary tube has a lower end. The lower end is operatively coupled with the minor section. The lower end extends upwardly from the top panel. The primary tube has an upper end. The upper end has a primary sprinkler head. The primary sprinkler head is positioned over the major section. The primary sprinkler head is located between 5.5 feet and 6.5 feet above the major section.

Further provided is a water path. In this manner water flows to the primary sprinkler head and then to at least one person on the cover plate. The water path includes an input coupling. The input coupling is provided on the front wall of the major section. In this manner water is received from a hose. The water path includes an output coupling. The output coupling is provided on the top panel of the minor section. In this manner the lower end of the primary tube is removably received. The water path also includes a valve. The valve is provided between the input and output couplings. The valve has an intermediate vertical tube. The intermediate vertical tube is secured to and reciprocable with the cover plate. The water path also includes an intermediate horizontal tube. The intermediate horizontal tube couples the input coupling to the intermediate vertical tube and primary tube when the cover plate is in the operative position. The intermediate horizontal tube uncouples the input coupling from the intermediate vertical tube and primary tube when the cover plate is in the inoperative position. The water path includes a sleeve. In this manner the vertical movement of the intermediate vertical tube is guided. The water path further includes a supplemental spring. The supplemental spring is provided within the sleeve. In this manner the intermediate vertical tube is urged upwardly.

Provided last is a generally J-shaped secondary tube. The secondary tube has a lower end. The lower end is operatively coupled with the minor section. The lower end extends upwardly from the top panel. The secondary tube has an upper end. The upper end has a primary sprinkler head. The primary sprinkler head is positioned over the major section. The primary sprinkler head is located between 5.5 feet and 6.5 feet above the major section. The secondary tube has an upper part. The secondary tube has a lower part. A ball valve is provided. The ball valve is provided between the upper and lower parts. A supplemental sprinkler head is provided. The supplemental sprinkler head is coupled to the ball valve. An operator controlled handle is provided. In this manner the flow of water through the primary and supplemental sprinkler heads is selectively directed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable shower system which has all of the advantages of the prior art shower systems of known designs and configurations and none of the disadvantages.

It is another object of the present invention to provide a new and improved portable shower system which may be easily and efficiently manufactured and marketed.

It is further object of the present invention to provide a new and improved portable shower system which is of durable and reliable constructions.

An even further object of the present invention is to provide a new and improved portable shower system which is susceptible of a low cost of manufacture with regard to both materials and labor, and which accordingly is then susceptible of low prices of sale to the consuming public, thereby making such portable shower system economically available to the buying public.

Even still another object of the present invention is to provide a portable shower system for initiating and terminating the flow of shower water in response to the presence and absence of at least one person positioned in a path of flow of the shower water, the initiating and terminating being in a safe, convenient and economical manner.

Lastly, it is an object of the present invention to provide a new and improved portable shower system. A base assembly has a major section with an open top, a minor section with a top panel and a cover plate with a down-turned flange. The cover plate is positioned over the major section. Springs between the cover plate and the major section hold the cover plate in an inoperative orientation above the major section and an operative orientation in contact with the major section. A J-shaped tube has a lower end operatively coupled with the minor section and extending upwardly from the top panel. The J-shaped tube has an upper end with a primary sprinkler head positioned over the major section. A water path includes an input coupling on the major section for receiving water from a hose. The water path includes an output coupling on the top panel for removably receiving the lower end of the J-shaped tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a portable shower system constructed in accordance with the principles of the present invention.

FIG. 2 is a left side elevational view of the system taken along line 2-2 of FIG. 1.

FIG. 3 is a cross sectional view of the system taken along line 3-3 of FIG. 2.

FIG. 4 is a cross sectional view of the system taken along line 4-4 of FIG. 3.

The same reference numerals refer to the same parts throughout the various Figures.

DESCRIPTION OF THE PREFERRED EMBODIMENT

Figure 5:
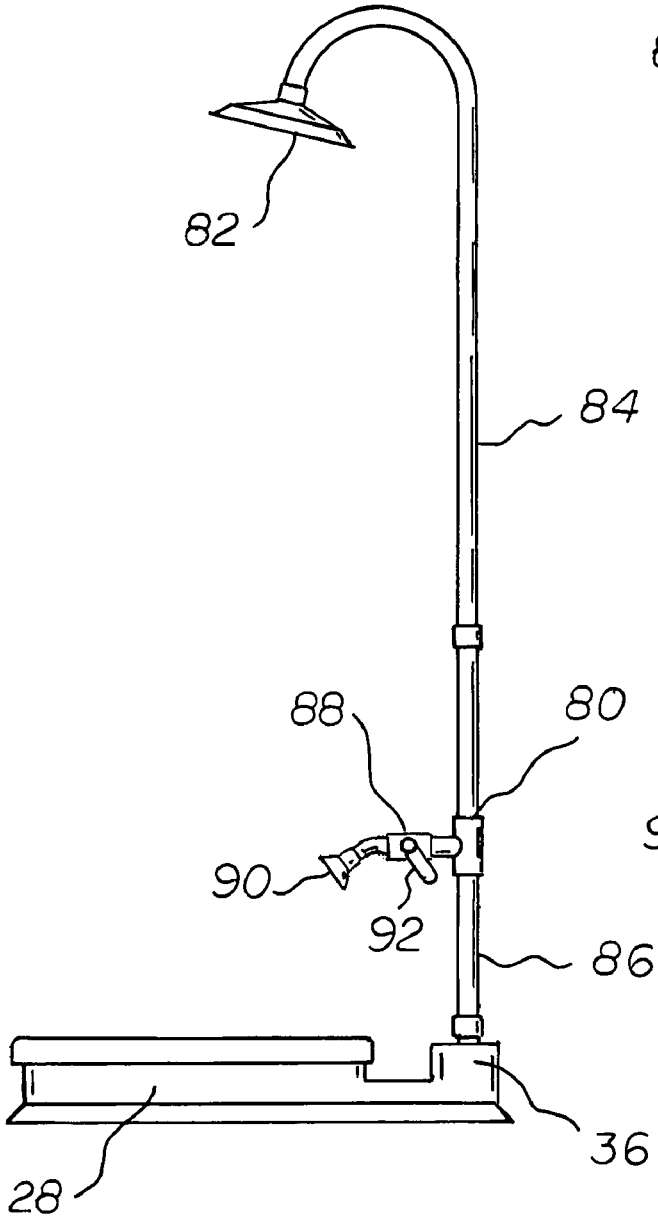
FIG. 5 is a front elevational view similar to FIG. 1 but illustrating an alternate embodiment of the invention.
Figure 6:
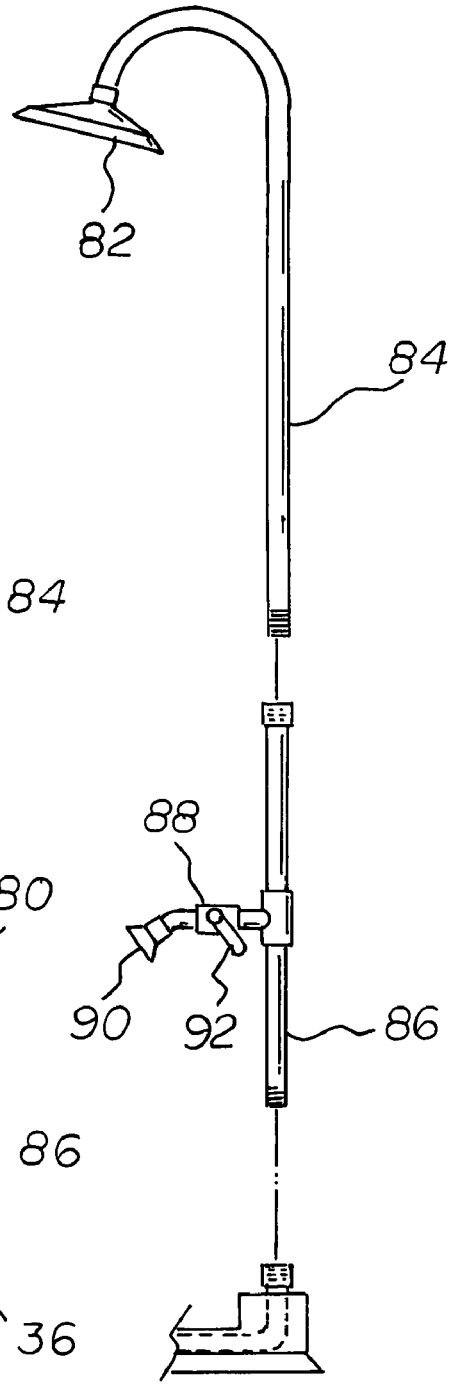
FIG. 6 is an exploded view of a portion of the system shown in FIG. 5.

With reference now to the drawings, and in particular to FIG. 1 thereof, the preferred embodiment of the new and improved portable shower system embodying the principles and concepts of the present invention and generally designated by the reference numeral 10 will be described.

The present invention, the portable shower system 10 is comprised of a plurality of components. Such components in their broadest context include a base assembly, springs, a J-shaped tube, and a water path. Such components are individually configured and correlated with respect to each other so as to attain the desired objective.

First provided is a base assembly 14. The base assembly is in a generally rectilinear configuration. The base assembly has a floor 16. The floor is positionable upon a recipient surface. The base assembly has a front wall 18. The base assembly has a rear wall 20. The base assembly has a first side wall 22. The base assembly also has a second side wall 24. The front and rear walls are parallel. The front and rear walls have a common length. The first and second side walls are parallel. The first and second side walls have a common length. The length of the first and second side walls is less than the length of the front and rear walls. The front and rear walls are perpendicular to the first and second side walls.

The base assembly has a square major section 28. The major section is formed of the first side wall and major portions of the front and rear walls. The major section has a major intermediate wall 30. The major intermediate wall is provided between the front and rear walls. The major intermediate wall is parallel with the first side wall. The major section has an open top 32. The open top is in a square configuration.

The base assembly has a minor section 36. The minor section is formed of the second side wall and minor portions of the front and rear walls. The minor section has a minor intermediate wall 38. The minor intermediate wall is provided between the front and rear walls. The minor intermediate wall is parallel with the second side wall. The minor section has a top panel 40. The top panel is in a rectangular configuration. The top panel is laterally offset from the major section.

A cover plate 44 is provided. The cover plate is in a square configuration. The cover plate is positioned over the open top of the major section. The cover plate has a down-turned flange 46. The down-turned flange encompasses an upper extent of the first side wall and major portions of the front and rear walls and the major intermediate wall. The cover plate and housing are fabricated of a rigid, water resistant material. The rigid, water resistant material is selected from the class of rigid materials. The class of rigid materials includes plastic and metal. The cover plate has water directing grooves.

Four vertically positioned coil springs 50 are provided next. The coil springs have upper ends and lower ends. One of the coil springs is located adjacent to each corner of the square major section. Four lower stubs 52 are provided. The lower stubs extend upwardly from the floor. Each lower stub receives the lower end of one of the coil springs. Four upper stubs 54 are provided. The upper stubs extend downwardly from the cover plate. Each upper stub receives the upper end of one of the coil springs. The coil springs are of a length to hold the cover plate in a horizontal inoperative orientation. In the horizontal inoperative orientation the cover plate is above the major section when no person is standing on the cover plate. The coil springs are of a length to hold the cover plate in a horizontal operative orientation. In the horizontal operative orientation the cover plate is in contact with the major section when at least one person is standing on the cover plate.

Provided next is a generally J-shaped primary tube 58. The primary tube has a lower end. The lower end is operatively coupled with the minor section. The lower end extends upwardly from the top panel. The primary tube has an upper end. The upper end has a primary sprinkler head 60. The primary sprinkler head is positioned over the major section. The primary sprinkler head is located between 5.5 feet and 6.5 feet above the major section.

Further provided is a water path. In this manner water flows to the primary sprinkler head and then to at least one person on the cover plate. The water path includes an input coupling 64. The input coupling is provided on the front wall of the major section. In this manner water is received from a hose. The water path includes an output coupling 66. The output coupling is provided on the top panel of the minor section. In this manner the lower end of the primary tube is removably received. The water path also includes a valve 68. The valve is provided between the input and output couplings. The valve has an intermediate vertical tube 70. The intermediate vertical tube is secured to and reciprocable with the cover plate. The water path also includes an intermediate horizontal tube 72. The intermediate horizontal tube couples the input coupling to the intermediate vertical tube and primary tube when the cover plate is in the operative position. The intermediate horizontal tube uncouples the input coupling from the intermediate vertical tube and primary tube when the cover plate is in the inoperative position. The water path includes a sleeve 74. In this manner the vertical movement of the intermediate vertical tube is guided. The water path further includes a supplemental spring 76. The supplemental spring is provided within the sleeve. In this manner the intermediate vertical tube is urged upwardly.

Provided last is a generally J-shaped secondary tube 80. The secondary tube has a lower end. The lower end is operatively coupled with the minor section. The lower end extends upwardly from the top panel. The secondary tube has an upper end. The upper end has a primary sprinkler head 82. The primary sprinkler head is positioned over the major section. The primary sprinkler head is located between 5.5 feet and 6.5 feet above the major section. The secondary tube has an upper part 84. The secondary tube has a lower part 86. A ball valve 88 is provided. The ball valve is provided between the upper and lower parts. A supplemental sprinkler head 90 is provided. The supplemental sprinkler head is coupled to the ball valve. An operator controlled handle 92 is provided. In this manner the flow of water through the primary and supplemental sprinkler heads is selectively directed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable shower system comprising:

a base assembly having a major section with an open top, a minor section with a top panel, a cover plate with a down-turned flange, the cover plate being positioned over the major section;

springs between the cover plate and the major section to hold the cover plate in an inoperative orientation above the major section and an operative orientation in contact with the major section;

a J-shaped tube having a lower end operatively coupled with the minor section and extending upwardly from the top panel, the J-shaped tube having an upper end with a primary sprinkler head positioned over the major section; and a water path including an input coupling on the major section for receiving water from a hose, the water path including an output coupling on the top panel for removably receiving the lower end of the J-shaped tube.

2. The system as set forth in claim 1 and further including:

a valve in the water path between the input and output couplings, the valve having an intermediate vertical tube secured to and reciprocable with the cover plate, an intermediate horizontal tube coupling the input coupling to the intermediate vertical tube and J-shaped tube when the cover plate is in the operative position, the intermediate horizontal tube uncoupling the input coupling from the intermediate vertical tube and J-shaped tube when the cover plate is in the inoperative position, a sleeve to guide the vertical movement of the intermediate vertical tube, a supplemental spring to urge the intermediate vertical tube upwardly.

3. The system as set forth in claim 1 wherein the J-shaped tube is of a one piece construction with the primary sprinkler head between 5.5 feet and 6.5 feet above the cover plate.

4. The system as set forth in claim 1 and further including a secondary tube having a lower end operatively coupled with the minor section and extending upwardly from the top panel, the secondary tube having an upper end with the primary sprinkler head positioned over the major section, the primary sprinkler head being located between 5.5 feet and 6.5 feet above the major section, the secondary tube being formed of an upper part and a lower part with a ball valve between the upper and lower parts, a supplemental sprinkler head coupled to the ball valve with an operator controlled handle to selectively direct the flow of water through the primary and supplemental sprinkler heads.

5. A portable shower system for initiating and terminating the flow of shower water in response to the presence and absence of at least one person positioned in a path of flow of the shower water, the system comprising, in combination:

a base assembly having a generally rectilinear configuration with a floor positionable upon a recipient surface and a front wall and a rear wall and a first side wall and a second side wall, the front and rear walls being parallel and of a common length, the first and second side walls being parallel and of a common length less than the length of the front and rear walls, the front and rear walls being perpendicular to the first and second side walls;

the base assembly having a square major section formed of the first side wall and major portions of the front and rear walls and a major intermediate wall between the front and rear walls and parallel with the first side wall, the major section having an open top in a square configuration;

the base assembly having a minor section formed of the second side wall and minor portions of the front and rear walls and a minor intermediate wall between the front and rear walls and parallel with the second side wall, the minor section having a top panel in a rectangular configuration laterally offset from the major section;

a cover plate in a square configuration positioned over the open top of the major section, the cover plate having a down-turned flange encompassing an upper extent of the first side wall and major portions of the front and rear walls and the major intermediate wall, the cover plate and housing being fabricated of a rigid, water resistant material selected from the class of rigid materials including plastic and metal, the cover plate having water directing grooves;

four vertically positioned coil springs with upper ends and lower ends, one of the springs being located adjacent to each corner of the square major section, four lower stubs extending upwardly from the floor with each lower stub receiving the lower end of one of the coil springs, four upper stubs extending downwardly from the cover plate with each upper stub receiving the upper end of one of the coil springs, the coil springs being of a length to hold the cover plate in a horizontal inoperative orientation above the major section when no person is standing on the cover plate, the coil springs being of a length to hold the cover plate in a horizontal operative orientation in contact with the major section when at least one person is standing on the cover plate;

a generally J-shaped primary tube having a lower end operatively coupled with the minor section and extending upwardly from the top panel, the primary tube having an upper end with a primary sprinkler head positioned over the major section, the primary sprinkler head being located between 5.5 feet and 6.5 feet above the major section;

a water path for the flow of water to the primary sprinkler head and then to at least one person on the cover plate, the water path including an input coupling on the front wall of the major section for receiving water from a hose, the water path including an output coupling on the top panel of the minor section for removably receiving the lower end of the primary tube, the water path also including a valve between the input and output couplings, the valve having an intermediate vertical tube secured to and reciprocable with the cover plate, an intermediate horizontal tube coupling the input coupling to the intermediate vertical tube and primary tube when the cover plate is in the operative position, the intermediate horizontal tube uncoupling the input coupling from the intermediate vertical tube and primary tube when the cover plate is in the inoperative position, a sleeve to guide the vertical movement of the intermediate vertical tube, a supplemental spring within the sleeve to urge the intermediate vertical tube upwardly; and a generally J-shaped secondary tube having a lower end operatively coupled with the minor section and extending upwardly from the top panel, the secondary tube having an upper end with a primary sprinkler head positioned over the major section, the primary sprinkler head being located between 5.5 feet and 6.5 feet above the major section, the secondary tube being formed of an upper part and a lower part with a ball valve between the upper and lower parts, a supplemental sprinkler head coupled to the ball valve with an operator controlled handle to selectively direct the flow of water through the primary and supplemental sprinkler heads.

* * * * *